US009636712B2

(12) United States Patent
Guenter et al.

(10) Patent No.: US 9,636,712 B2
(45) Date of Patent: May 2, 2017

(54) DEVICE FOR SIFTING GRANULAR MATERIAL

(71) Applicant: MASCHINENFABRIK KÖPPERN GMBH & CO. KG, Hattingen (DE)

(72) Inventors: Harald Guenter, Freiberg (DE); Thomas Hanstein, Freiberg (DE); Eberhard Neumann, Herdecke (DE); Eggert De Weldige, Velbert Langenberg (DE)

(73) Assignee: MASCHINENFABRIK KOEPPERN GMBH & CO. KG, Hattingen (DE)

( * ) Notice: Subject to any disclaimer, the term of this patent is extended or adjusted under 35 U.S.C. 154(b) by 327 days.

(21) Appl. No.: 14/357,153

(22) PCT Filed: Nov. 23, 2012

(86) PCT No.: PCT/EP2012/073513

§ 371 (c)(1),
(2) Date: May 8, 2014

(87) PCT Pub. No.: WO2013/079416

PCT Pub. Date: Jun. 6, 2013

(65) Prior Publication Data

US 2014/0306044 A1 Oct. 16, 2014

(30) Foreign Application Priority Data

Nov. 28, 2011 (DE) ..... 10 2011 055 762

(51) Int. Cl.
*B07B 7/083* (2006.01)
*B07B 4/08* (2006.01)
(Continued)

(52) U.S. Cl.
CPC ..... *B07B 4/08* (2013.01); *B02C 21/005* (2013.01); *B02C 23/12* (2013.01); *B02C 23/14* (2013.01);
(Continued)

(58) Field of Classification Search
CPC .. B07B 4/04; B07B 4/08; B07B 7/083; B07B 9/02; B02C 23/12; B02C 23/14
See application file for complete search history.

(56) References Cited

U.S. PATENT DOCUMENTS 1,499,721 A * 7/1924 Holt ..... B07B 4/025 209/137
2,956,680 A * 10/1960 Puhr-Westerheide ..... F23J 3/02 209/151
(Continued)

FOREIGN PATENT DOCUMENTS

DE 1002600 A 2/1957
DE 253771 A 2/1988
(Continued)

*Primary Examiner* — Joseph C Rodriguez
(74) *Attorney, Agent, or Firm* — Andrew Wilford

(57) ABSTRACT

An apparatus for separating granular material into at least three fractions a static cross-flow sifter and a dynamic sifter. The static has several impact and flow-conducting elements stepped one below the other in a housing having a first material inlet, at least one sifting-gas inlet and at least one coarse-particle outlet. The dynamic sifter has a rod basket rotatable about a vertical axis, a housing containing the basket, and at least one medium-particle outlet and one fine-particle outlet. The housing of the static sifter merges directly horizontally and laterally into the housing of the dynamic sifter.

22 Claims, 3 Drawing Sheets

(51) Int. Cl.

| | |
|---|---|
| ***B07B 4/04*** | (2006.01) |
| ***B07B 9/02*** | (2006.01) |
| ***B02C 21/00*** | (2006.01) |
| ***B02C 23/12*** | (2006.01) |
| ***B02C 23/14*** | (2006.01) |

(52) U.S. Cl.
CPC ..... *B07B 4/04* (2013.01); *B07B 7/083* (2013.01); *B07B 9/02* (2013.01)

(56) References Cited

U.S. PATENT DOCUMENTS

| | | | | |
|---|---|---|---|---|
| 4,690,335 | A | 9/1987 | Allers | |
| 4,726,531 | A | 2/1988 | Strasser | |
| 5,392,998 | A * | 2/1995 | Suessegger | B02C 21/00 209/143 |
| 5,505,389 | A | 4/1996 | Suessegger | |
| 6,347,707 | B1 * | 2/2002 | Sussegger | B02C 23/12 209/133 |
| 6,405,405 | B1 * | 6/2002 | Hauch | B07B 11/04 15/309.2 |
| 6,695,911 | B2 * | 2/2004 | Ramesohl | B02C 4/02 106/745 |
| 6,845,867 | B2 * | 1/2005 | Sussegger | B07B 4/04 209/135 |
| 6,902,126 | B2 * | 6/2005 | Chen | B02C 15/045 241/79.1 |
| 7,300,007 | B2 | 11/2007 | Hagedorn | |
| 7,712,611 | B2 * | 5/2010 | Longhurst | B07B 9/02 209/137 |
| 7,854,406 | B2 | 12/2010 | Neumann | |
| 8,210,458 | B2 | 7/2012 | Strasser | |
| 9,067,213 | B2 * | 6/2015 | Bohm | B02C 4/06 |
| 2010/0116720 | A1 * | 5/2010 | Mendelin | B07B 4/02 209/235 |

FOREIGN PATENT DOCUMENTS

| | | | |
|---|---|---|---|
| DE | 4223762 | A | 1/1994 |
| DE | 19751627 | A | 5/1999 |
| DE | 102004027128 | A | 12/2005 |
| DE | 102006039775 | A | 2/2008 |
| JP | 5-74681 | | 10/1993 |
| JP | 6-106135 | | 4/1994 |

* cited by examiner

DEVICE FOR SIFTING GRANULAR MATERIAL

CROSS REFERENCE TO RELATED APPLICATIONS

This application is the US-national stage of PCT application PCT/EP2012/073513 filed 23 Nov. 2012 and claiming the priority of German patent application 102011055762.8 itself filed 28 Nov. 2011.

FIELD OF THE INVENTION

The invention relates to an air classifier for granular material into at least three fractions, comprising at least one static sifter forming a first sifting stage and at least one dynamic sifter forming a second sifting stage.

BACKGROUND OF THE INVENTION

In such an air classifier, the static sifter has a plurality of impact and conducting elements stepped one below the other inside a housing having at least one first material inlet, at least one sifting-gas inlet, and at least one coarse-particle outlet, and the dynamic sifter is a rod-basket sifter with a rotary rod basket and having a second housing with at least one medium-particle outlet and one fine-particle outlet.

The granular material to be sifted can be, for example, cement, cement-containing materials, cement raw material, limestone or slag, but also ore and the like. Roll crushers and/or material bed roll mills are used in practice for the comminution of such granular materials. In this high-pressure comminution of granular material, such granular material is crushed in the nip between two press rollers (material bed comminution). Agglomerates are formed during the comminution action, which are referred to as scales. Such material bed roll mills can be operated in a closed circuit with a static and/or dynamic sifter. The material bed roll mill is positioned therein, for example, below a sifter such that any coarse material fraction that is discharged from the sifter is fed back to the roll mill. The material discharged from the roll mill is refed to the material inlet of the air classifier that is a multistage apparatus including a static sifter and a dynamic sifter. The scales are deagglomerated in the static sifter by the impact and conducting elements; simultaneously, the coarse material fraction is separated and fed to the roll crusher. The "finer" material arrives together with the sifting gases in the dynamic sifter where it is subjected to a fine-sifting process. The fine material that is sifted from this sifter is discharged together with the sifting gas and captured as finished material in the cyclones and/or filters that follow downstream. The medium fraction that is sifted from the dynamic sifter can also be refed, for example, to the roll crusher or a further milling stage. Operative measures of this kind of are known from the prior art (see, for example, DE 43 37 215 [U.S. Pat. No. 5,505,389].

An air classifier according to the type descried above is disclosed, for example, in DE 42 23 762. It has a rotary powered rod basket that is provided in a housing with turbo elements angularly arrayed around the rotor, with inlets and outlets for sifting air, material to be sifted, fine material, medium material and coarse material. A chute-like presifting chamber extends horizontally upstream and to the side of the rod basket at the same height and has, at the top, an inlet opening for the material to be sifted that is separated from the sifting air and an opening for the sifting air that is laterally opposite the rod basket, and, at the bottom, an outlet opening for a sifted coarse-grained fraction and two chute-delimiting walls that are permeable for the sifting air and that together form a presifting zone. These chute-delimiting walls of the presifting chamber that are permeable for the sifting air and include angled blind-like metal guides that are tilted toward the bottom toward the outlet opening of the sifted coarse material fraction and provide, as impact and conducting elements, deagglomeration action for the scale.

It was further proposed to provide roof-shaped assemblies that are arranged in a cascade on air classifiers, such that the edge of the ridge of each assembly is approximately perpendicular below the discharge edge of the surface of the assembly, which is provided upstream (see DE 1 002 600).

WO 2003/097241 [U.S. Pat. No. 7,300,007] discloses a further air classifier of this type where the dynamic sifter is equipped with a rod basket that rotates about a horizontal axis, as in DE 42 23 762. To minimize problems involved in the mechanical conveying of the grinding stock that is transported in the circuit, this known prior art proposes mounting the static cascade sifter below the roll nip of the roll crusher, and the post-sifter above this roll crusher that is designed, in particular, as a dynamic rod-basket sifter. Disadvantageously, however, this embodiment has a considerable structural height. The connecting line between the two sifters increases the investment and operating costs.

An alternate embodiment of an air classifier in multiple stages and compact structural form is disclosed in U.S. Pat. No. 7,854,406. The air classifier therein has a plurality of concentric housings, with a rotating rod basket that rotates about a vertical axis as a post-sifting stage. The presifting stage is constituted by a simple cyclone, and the material to be sifted and the sifting gas are fed via a common supply line that is connected to the housing in a spiral. Any deagglomeration of the scale is only possible to a limited degree in the course of the static sifting stage.

DE 10 2004 027 128 discloses an air classifier for granular material for obtaining at least three grain fractions and having a static sifter and a dynamic sifter in a rotationally symmetrical array about a common axis inside a common housing.

Finally, DE 10 2006 039 775 discloses an air classifier in a special modality of construction having a static cascade sifter and a further sifter as a post-sifter, wherein the cascade sifter has two packs of conical rings that are provided spaced one above the another and concentrically relative to one another.

DD 253771 discloses, furthermore, a air classifier for separating, in particular, fine-grained bulk materials into at least two fractions having a cylindrical top housing part extended downward as a granule-type cone with granule discharge. The rod basket therein rotates about a vertical axis. The material distribution inside the sifter chamber of sifters with rod baskets is to be improved in that the precision at separation is increased and energy consumption with regard to the final product is reduced, irrespective of the speed and form of a given rotor. To this end, an annular container with rotating base is provided as a dispersing apparatus that is above the sifting-gas inlet pipe in the area of the rod basket inside or outside of the housing and connected to the sifter chamber via an annular gap and/or an annular channel.

The known sifters of the type as previously described have basically proven themselves useful in practice; however, there still remains the potential for improvement, particularly with regard to the sifter efficiency.

OBJECT OF THE INVENTION

Therefore, it is the object of the present invention to provide an air classifier for granular material into at least three fractions, as described above in the introduction, that is characterized by an especially compact structural assembly, as well as minimal investment and operating costs while providing superior sifting efficiency.

In particular, such an air classifier must facilitate the economic operation of a grinding mill having at least one roll crusher and providing a high level of sifting efficiency.

SUMMARY OF THE INVENTION

To achieve this object, in an air classifier for granular material of this class that is provided for sifting granular material into at least three fractions, the invention teaches that the housing of the static sifter merges directly via a for example chute-like housing tilted to the vertically laterally directly into the housing of the dynamic sifter, and the rod basket of the dynamic sifter rotates about a vertical axis.

In achieving this task, the invention relies first on the, in principle, known discovery that it is advantageous when a static sifter is combined with a dynamic sifter as a rod-basket sifter, because, using the static sifter, it is possible to sift and separate a first coarse-particle fraction, such that the dynamic sifter, which has rotating components that are quite sensitive, is not unnecessarily stressed by exposure to coarse material. According to the invention, the static and the dynamic sifter are combined into a particularly efficient and compact structural assembly in that, on the one hand, a rod basket with a vertical axis of rotation is used and in that, on the other hand, the static sifter is directly laterally connected to the dynamic sifter, and wherein, in terms of process engineering, the static sifter assumes the role of breaking up agglomerated scale as well as the initial separation of coarse material. The static sifter and the dynamic sifter are consequently provided in close spatial proximity of each other, such that both sifters operate particularly efficiently from an energy point of view; plus, the static sifter is simultaneously able to fulfill the task of breaking up agglomerated scale.

In combination with the connection means of the static sifter to the dynamic sifter according to the invention, the use of the rod-basket sifter that rotates about a vertical axis is of special significance. In fact, this configuration with a "vertical" rod-basket sifter is characterized by an even flow against the rod basket or rotor and thereby improved sifter efficiency. The problems associated with the rod basket axes of the prior art that have a "horizontal" orientation are avoided in the context of the present invention, so it is possible to achieve superior sifting efficiency overall.

According to a first embodiment, it is possible for the housing of the static sifter to open at a tangential or spiral-like orientation into the housing of dynamic sifter. In a second embodiment, there exists the alternate option of the static sifter merging radially into the housing of the dynamic sifter. Finally, comprised as further alternate options are such embodiments where the connection of the static sifter is between tangential orientation and the radial orientation.

In any case, the housing of the static sifter is always connected to the housing of the dynamic sifter in a compact lateral fashion, with the static housing merging into the dynamic housing. Therefore, the sifter according to the invention has housing areas, that, by being transitional areas between the static sifter and the dynamic sifter, can be allocated both to the static and to the dynamic sifter. It is correspondingly provided, for example, that the housing of the dynamic sifter has an upper housing section where the rotating rod basket is provided; plus, it has a lower housing section that has, for example, a discharge funnel for the medium material therein, and the static sifter is connected by the housing thereof to the lower housing section of the dynamic sifter, merging into this lower housing section. This lower housing section of the dynamic sifter thus constitutes the transitional area between the static sifter and the dynamic sifter. The housing of the dynamic sifter can preferably have a cylindrical design, in that the top housing section and/or the lower housing section can be cylindrical. In that case, the lower housing section of the dynamic sifter also functions as a cyclone able to influence the action of the static sifter as well as the action of the dynamic sifter. Correspondingly, the cyclone, as constituted by the lower housing section, can influence the effect of the static sifting stage. Simultaneously, however, it is possible to view this cyclone also as a part of the dynamic sifter, as it constitutes a flow distribution channel for the vertical flow admission against the rod basket, and due to the fact that the discharge funnel of the dynamic sifter can also be provided inside this housing section. This aspect further illustrates that, according to the invention, the static sifter and the dynamic sifter are closely connected to each other, both in terms of space as well as function.

As described previously, the static sifter is preferably connected to the lower housing section of the dynamic sifter. In that case, the static sifter (seen in a side view) is typically positioned below the rod basket. In an alternate option, however, it is also within the scope of the present invention to dispose the static sifter and/or the static sifters at the same height, or at least in sections at the same height, relative to the rotating rod basket.

Not only does a separation of coarse material and medium material occur inside the static sifter, breaking up agglomerated scale can be done there as well. The scale deagglomeration is done by the impact and conducting elements integrated inside the static sifter. The impact and conducting elements can be formed by baffle plates and/or metal guides that are known in the art. According to a preferred embodiment, the angle at which these plates and/or metals are set can be adjustable, for example, by pivoting about respective horizontal axes. Due to the fact that the functionality of the static sifter can only be influenced to a limited degree during operation, which is contrary to a dynamic sifter, providing such a means for adjustment is handy. It is thus possible to set the desired conditions of the static sifter, such that it is possible to optimize, in particular, the flow properties. Alternately, it is possible to provide the impact and conducting elements as roof-shaped assemblies, such as disclosed, for example, by DE 1 002 600. The roof-shaped assemblies can be optionally displaceable horizontally. The tasks of scale deagglomeration, on the one hand, and coarse material separation, on the other hand, are consistently combined inside the static sifter.

While the (second) housing of the dynamic sifter is typically cylindrical, or it is at least in sections cylindrical, the static sifter has a chute-like and/or box-like housing that is preferably aligned at an acute angle relative to the vertical, such that the impact and conducting elements provided on its inside are also oriented at an angle. The chute-like housing has, on the one hand, the material inlet or inlets for the material to be sifted and, on the other hand, at least one sifting-gas inlet through which, for example, air is supplied. To this end, the chute-like housing can have a (lower) chute wall oriented at a preset angle of between 10° and 80°, for example 40° to 60°. Consequently, the housing (seen in a side view) can be provided as tilted overall relative to the vertical. The same applies with regard to the impact and conducting elements stepped one below the other inside the housing. The sifter zone of the first sifting stage is formed between them and is oriented at a preset angle α of between 20° and 70°, for example 20° to 40°, to the vertical. However, the invention also comprises a chute-like housing that is not tilted relative to the vertical but instead as parallel to the vertical.

The sifting-gas inlet can be formed by, for example, at least one inlet opening that opens at an angle above the elements. Alternately or additionally, it is possible for the sifting-gas inlet to be formed by one or a plurality of openings that are provided in the chute wall. It is possible to provide for these openings to be blocked, for example, by doors, so that the sifting gas supply can be varied by opening and closing the doors. Correspondingly, it is within the scope of the present invention to provide either for an (upper) inlet opening in the manner described above or for openings that are provided inside the wall of the chute. Preferred, however, is the implementation of a combination of these measures, such that at least one inlet opening is envisioned as provided at an angle above the elements as well as one or a plurality of openings that are provided inside the wall of the cute, and wherein these openings can be optionally blocked for example by doors. This way, it is possible to work with a "variable" air flow, and thereby air volume control. It is expedient therein to provide that single doors can opened and closed individually, in groups and/or all together at the same time, and it is particularly preferred to provide via the settings of the openings for a variable and targeted adjustment. The term "doors" in the context of the present invention relates in general to any means for opening and blocking the openings and, in particular, for adjusting the amount of air passing through them. By working with a suitable air volume control, it is possible to further increase the sifter efficiency.

Furthermore, optionally and additionally, it is also possible for the sifting-gas inlet to be formed by a part of the shifter housing that has no chute wall. In this embodiment, it is possible to omit the chute wall and work with an open flow application.

Of particular importance is, in the context of the present invention, the combination of the laterally provided housing and the vertical rod basket for example the tangential or spiral-like connection of the housing to the rod basket. The direction of rotation of the rod basket can be oriented in or against the tangential or spiral-like direction of the connection, of the static housing.

It is particularly preferred when the dynamic sifter is provided in the upper part thereof, for example in the top housing section, with one or a plurality of further material inlets. This is particularly advantageous, when the sifter is integrated in a multistage grinding mill, because in that case the crushed material can be fed to a second stage for sifting via this (second) material inlet. This can be, for example, the discharge material of a second comminuter such as, for example, a ball mill. The incorporation of the air classifier in a single- or multistage grinding mill will explained in further detail below.

The scope of the invention provides, in principle, that an individual static sifter is connected in the manner as provided according to the invention such as, for example, tangentially or spiral-like, respectively, to the dynamic sifter. It is preferred, however, particularly for large units, when two or even more static sifters having one housing each are connected, respectively, to the dynamic sifter. Presifting for separating a coarse-particle fraction and the deagglomeration of scales can therefore be achieved parallel in several sifting stages, wherein the individual presifting stages apply action in a parallel manner to one and the same dynamic sifter. The plurality of static sifters therein is preferably connected (in the top view) symmetrically. Correspondingly, it is within the scope of the invention to provide that the plurality of the static sifters is provided "symmetrically" angularly equispaced. The angular offset is 360°/n, where "n" is the number of static sifters. Hence, this means that, when two static sifters are used, seen in a top view, they are preferably connected to the dynamic sifter offset by an angle of 180°. When three static sifters are employed, these are preferably provided offset by an angle of approximately 120° each. When four static sifters are used, these are preferably provided offset relative to each other by an angle of 90° each, etc.

In addition to the impact and conducting elements provided inside the static sifter, it can be useful to provide impact elements in the dynamic sifter as well such as, for example, in the housing of the dynamic sifter, preferably in the lower housing section thereof that can, for reasons described above, assume the function of a cyclone. It is possible to connect impact elements on the housing wall of this cyclone that can operate as "stumbling edges" or "peeling edges." They are intended to counteract the cyclone effect of this part of the sifter, consequently reducing this cyclone effect. In fact, with the aid of the elements provided on the side of the wall, it is possible to redirect the material collecting in the wall area back toward the center and/or axis, whereby the sifter action is optimized.

According to a further proposal, the housing of the dynamic sifter is optionally provided with one or a plurality of additional air supplies that function as an air bypass. This way, the air supply is not handled solely via the air inlet of the static sifter; instead it is possible to supply additional air via the dynamic sifter. This results in the air supply being reduced in the static sifter such that, correspondingly, it is possible to achieve an optimized adjustment of the way in which air is guided. This additional air can be supplied, for example, in the upper housing section of the housing of the dynamic sifter.

Finally, it is within the scope of the present invention to optionally provide additional air distributors such as, for example, perforated plates and the like, in the area of the static sifter. They can be provided in the direction of flow inside the housing of the static sifter upstream of the impact and conducting elements. They improve the air distribution over the entire height of the static sifter.

The air classifier according to the invention can be used for separating granular materials of the most varied kinds, particularly for the sifting of cement, cement raw materials, limestone and similar materials. Alternately, the invention also comprises means for sifting ore, and the like. Naturally occurring resources of such materials have in part been greatly depleted; as a consequence, mining operations in this area have been shifted to poorly accessible regions without adequate water supplies. The sifter according to the invention can find particularly efficient applications in these circumstances.

The subject-matter of the present invention also relates to a single-stage (rotary grinding mill) or a multistage for comminuting granular material, including at least on first comminuter; and at least one air classifier of the kind as described above, wherein the material discharged by the first comminuter enters the air classifier via a first material inlet, and the coarse material discharged via the coarse-particle outlet of the air classifier (or the static sifter) is fed to the first comminuter, and the medium material or the medium fraction discharged from the air classifier (or the dynamic sifter) is also fed to the first comminuter or, alternately, also a second comminuter. It is therefore particularly preferred to provide, as a supplement to the first comminuter, a further second comminuter such that at least a dual-stage grinding mill is ultimately implemented. The first comminuter can preferably be a material bed roll mill, which is therefore a roll crusher. The second comminuter can be a ball mill, for example. The medium material sifted from the air classifier (namely the second sifting level) can therefore be fed into this second comminuter, for example a ball mill, and this material is comminuted by the second comminuter and can then, via the second material inlet, be fed once more back to the second sifting stage, namely to the dynamic sifter. Thus, the coarse material that was sifted in the first sifting stage is therefore fed to the roll crusher, while the medium material ("granules") is routed to the ball mill, and wherein the discharged material from the ball mill is fed to the dynamic sifter and the discharged material from the roll crusher is fed to the static sifting stage. This is therefore is an energetically particularly beneficial comminution of the material; specifically, using the described multistage sifter, and the second size-reduction stage does not require its own sifter.

However, as an alternate option, it is also possible to implement, for example, a multistage grinding mill that provides, in addition, for the use of a further sifter separately from the sifter according to the invention. The medium fraction of the described first sifter in turn is fed to a second comminuter such as, for example, a ball mill. The discharged material from this ball mill is now, in contrast, not returned again to the first sifter, as described previously; instead, it is fed to the second, separate sifter, and the coarse material discharged from this second sifter is fed once more into the ball mill, while the fine material that exists from the second sifter can be discharged as product.

Finally, the invention also comprises single-stage grinding apparatuses that provide for the coarse material as well as the medium material that are discharged from the air classifier to be fed into a first (single) comminuter, for example a roller crusher, and the material that exits from this comminuter re-enters the air classifier according to the invention via the material inlet thereof. As a result, a single-stage recirculating grinding mill is created.

It is further within the scope of the present invention that the first comminuter, for example a roll crusher, is provided above the air classifier. However, it is particularly preferred for the roll crusher to be provided below the air classifier.

BRIEF DESCRIPTION OF THE DRAWING

The invention will be illustrated in further detail based on drawings describing embodiments. Therein.

SPECIFIC DESCRIPTION OF THE INVENTION

The air classifier 1 shown in FIGS. 1 to 5 serves for separating granular material such as, for example, cement into at least three fractions. The apparatus 1 is composed of a static sifter 2 and a dynamic sifter 3 combined in a particularly compact fashion. The static sifter 2 constitutes a first sifting stage; the dynamic sifter 3 is downstream of the static sifter 2 in the direction of sifter medium flow and constitutes a second sifting stage.

Figure 1:
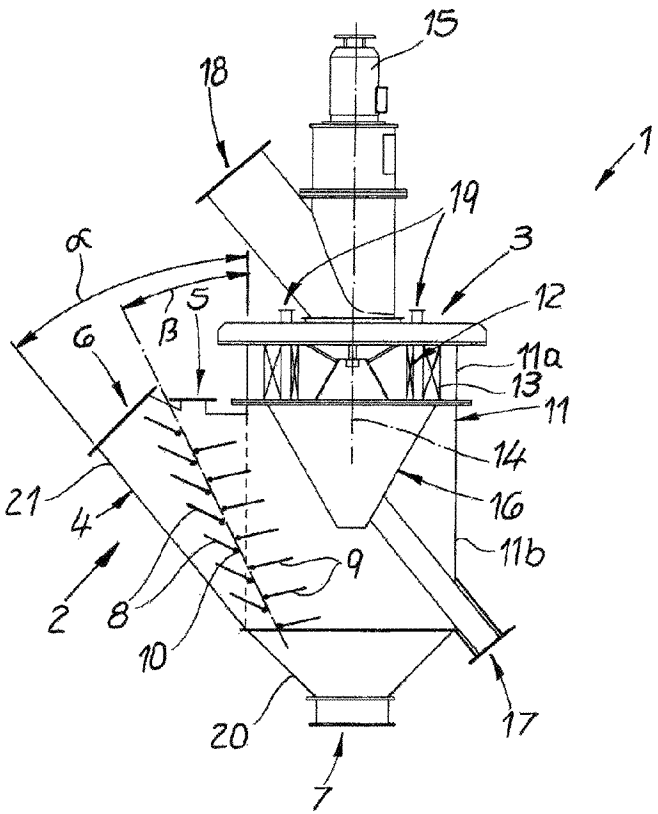
FIG. 1 is a partial vertical section through an air classifier according to the invention in a simplified view.

The static sifter 2 has a housing 4 having a first material inlet 5, a sifting-gas inlet 6 and a coarse-particle outlet 7. A plurality of impact and conducting elements 8 and 9 are stepped one below the other inside the housing 4. In this embodiment, these elements are impact plates 8 and 9 also acting as flow conductors for the static sifter. FIG. 1 shows that two groups of impact plates 8 and 9 are angled relative to each other, and these impact plates 8 and 9 are adjustable about pivot axes 10 such that the angles of the impact plates 8 and 9 can be adjusted.

The second sifting stage is formed by the dynamic sifter 3 that has a housing 11. This cylindrical housing 11 has a cylindrical upper section 11*a* and a cylindrical lower section 11*b*. A rotating rod basket 12 in the upper section 11*a* of this housing 11 is surrounded by a set of guide vanes 13. These are stationary guide vanes lying at a fixed or adjustable angle of incidence relative to the axis of rotation of the rod basket. The rod basket 12 rotates about a vertical axis 14. A drive mechanism 15 is connected to the upper end of the rod basket 12. A discharge cone 16 connected below the rod basket 12 inside the second housing 11 in turn is connected to a medium-particle outlet 17. A fine-particle outlet 18 is connected to the upper section 11*a* of the housing 11 and serves to discharge the suspension comprised of gas and fine material. Further material inlets 19 are connected, moreover, to the upper housing part 11*a*.

The starting material that is to be sifted is fed into the air classifier 1 via the first material inlet 5. The material to be sifted thus reaches the first sifting stage and the static sifter 2 through this material inlet 5. The gas inlet 3 supplies sifting gas such as, for example, air. This can also be, for example, hot drying gas. The material to be sifted now drops onto the array of impact and guide plates 8 and 9 for, in particular, breaking up the scale agglomerate that formed earlier during the grinding step in a roll crusher. The sifter medium flows through the material possibly providing simultaneous drying action. The static sifter operates as a cross-flow air classifier in that the coarse material drops through the housing 2 into the lower discharge cone 20 and is discharged from there via the coarse-particle outlet 7. This discharge cone 20 is structurally connected to the lower section 11*b* of the housing 11 of the dynamic sifter 3.

The static and the dynamic sifter are connected to each other by a very compact assembly, with the static sifter 2 merging into the dynamic sifter 3. In fact, the static sifter is laterally connected by the housing 4 thereof to the housing 11 of the dynamic sifter. In this embodiment the housing 4 of the static sifter 2 merges into the lower housing section 11*b* of the housing 11, so that the housing section 11*b* of the housing 11 can be functionally assigned in some sections, on the one hand, to the static sifter and in some sections, on the other hand, to the dynamic sifter. It also forms the connection between the static sifter and the dynamic sifter, and the cylindrical lower housing section 11*b* can also act as a cyclone.

At any rate, the fraction that is sifted out in the static sifter 2 enters together with the sifting gas into the dynamic sifter 3, namely the upper section 11*a* of the housing 11 and therein into the area of the rod basket 12. The desired fine sifting action occurs between this rotating rod basket 12 and the guide vanes 13. The "coarser" or medium fractions reach via the inner discharge funnel or discharge cone 16 and therefore the medium-particle outlet 17 ("granule discharge pipe"). This medium fraction is also referred to as "granules." The fine material is discharged together with the gases from the sifter through the fine-particle and gas outlet 18. Further material can be directly added to the second sifter stage via the additional material inlets 19. This can be, for example, material that is supplied from an additional comminuter such as, for example, a ball mill. This aspect will be addressed in further detail in the context of the description of FIG. 6.

Figure 2:
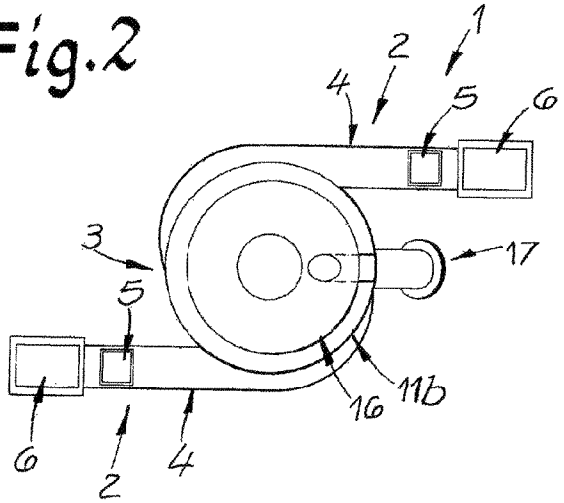
FIG. 2 is a top view of a first embodiment of the lower part of the classifier of FIG. 1.
Figure 3:
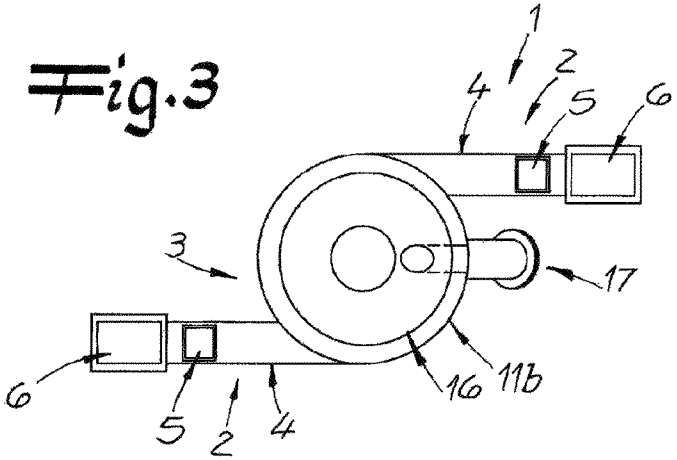
FIG. 3 is a top view of a second embodiment of the lower part of the classifier of FIG. 1.

FIGS. 2 and 3 show that, according to the invention, the static sifter 2 is directly connected to the second housing 11 of the dynamic sifter 3 by a chute-like first housing 4 that extends at an angle relative to the vertical; in this particular embodiment this is achieved by a tangential or spiral-like orientation. FIG. 2 shows an embodiment with a spiral-like connection, while FIG. 3 shows an embodiment with a tangential connection.

In both embodiments two static sifters 2 are connected by respective housings 4 to the housing 11 of the dynamic sifter 3. The dynamic sifter 3 thus receives material in parallel from two static sifters 2. To this end, the two sifters 2 in the embodiment are positioned offset by 180°. The direction of rotation of the rod basket can correspond to the orientation of the connection of the tangential or spiral-like input connection or can be opposite thereto.

Figure 5:
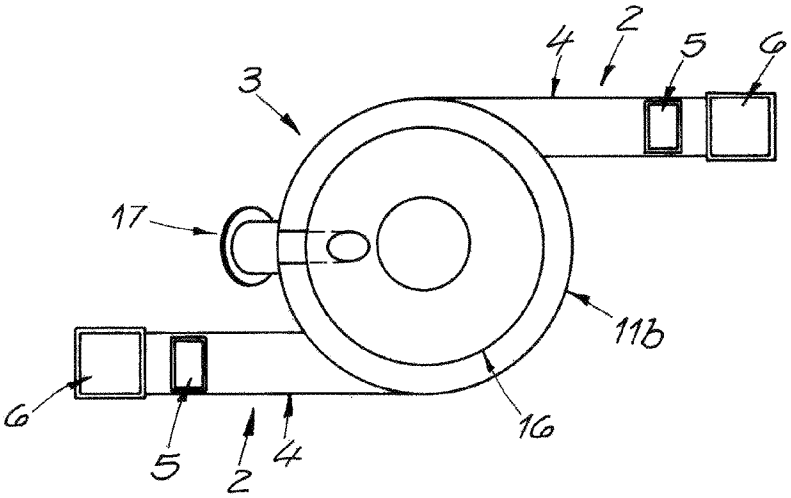
FIG. 5 is a top view of the lower part of the apparatus of FIG. 4.
Figure 4:
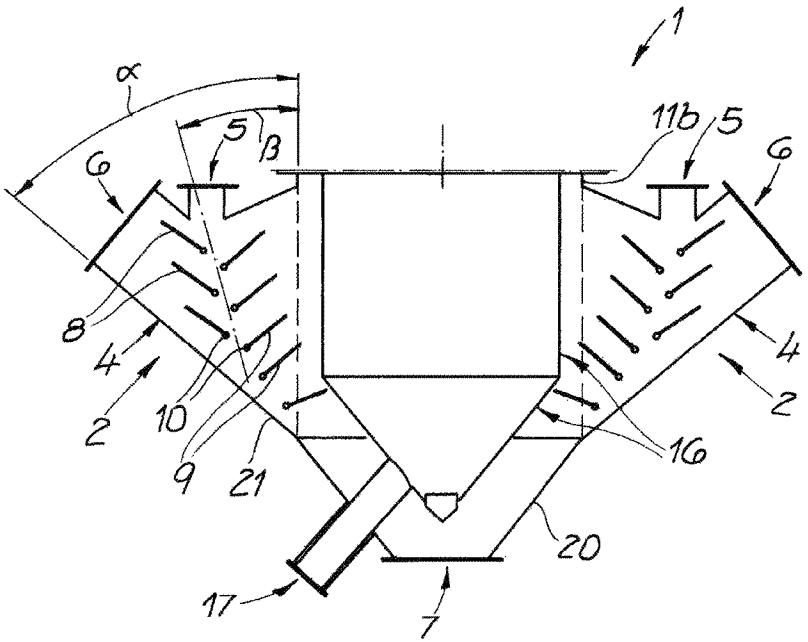
FIG. 4 is a modified embodiment of the apparatus of FIG. 1 with the lower part in section.

The embodiment shown in FIGS. 4 and 5 substantially corresponds to the embodiment according to FIGS. 1 and 3. This embodiment differs geometrically by the arrangement and design of the discharge funnel 16 of the dynamic sifter 3 that extends, in the embodiment according to FIGS. 4 and 5, over the entire height of the lower section 11*b* of the housing 11 and also over the entire height of the housing 4 of the static sifter 2. Aside from this, the embodiments according to FIGS. 1 to 3, on the one hand, and according to FIGS. 4 and 5, on the other hand, differ in terms of the geometric design thereof, particularly in the area of the static sifter and the conducting elements thereof. The basic structural assembly and functionality are identical, though.

The chute-like first housing, which is connected in a tangential or spiral-like orientation to the second housing, is of special significance. The figures demonstrate that this first chute-like first housing 4 or the lower chute wall 21 thereof is oriented angled at a preset angle $\alpha$ relative to the vertical. In the embodiment, this angle $\alpha$ is approximately 40° to 60°, for example approximately 50°. Furthermore, the sifter zone of the static sifter, which is created between the conducting plates 8 and 9 arrayed in steps one on above the other, is oriented at a certain angle $\beta$ relative to the vertical. In the embodiment, this angle $\beta$ is approximately 20° to 40°, for example 25°. According to the invention, this housing 4 that is overall oriented at an angle is connected to the housing of the dynamic sifter in a spiral-like or tangential manner.

The figures show an embodiment where the static sifter, although it is laterally connected to the dynamic sifter, is spatially positioned, however, below the rotating rod basket. Nonetheless, it is also optionally possible to use embodiments where the static sifter is provided (at least in sections) at the same height as the rotating rod basket. This applies with regard to embodiments having a plurality of static sifters.

Otherwise, in the shown embodiments, air is supplied, in particular, via the illustrate sifting-gas inlet 6. Alternately or additionally, it is possible to provide further sifting-gas inlets that are constituted in particular as openings in the chute wall 21. This situation is shown in the figures. It is possible to provide suitable means such as, for example, doors, slides, or the like for opening and blocking such openings, and it is possible to variably adjust such means, thereby varying the volume of air supplied.

The arrangement of the impact plates 8 and 9 is shown only by way of example in the figures. The pivots of the impact plates 8 and 9 do not necessarily have to lie on a common straight line; instead, they can be spaced relative to each other. This can be seen in particular in FIG. 4. However, alternately, it is also within the scope of the present invention that the pivots for the impact or conducting plates are approximately in a straight line, or that they overlay and are thus configured as engaging in each other. However, they can also be configured with intervening spaces as shown in the figures, the spacing being greater in FIG. 4 than in FIG. 1. The vertical spacings between the individual plates do not have to identical; instead, they can vary from plate to plate. Further, the plates can also be connected at different angles.

Figure 6:
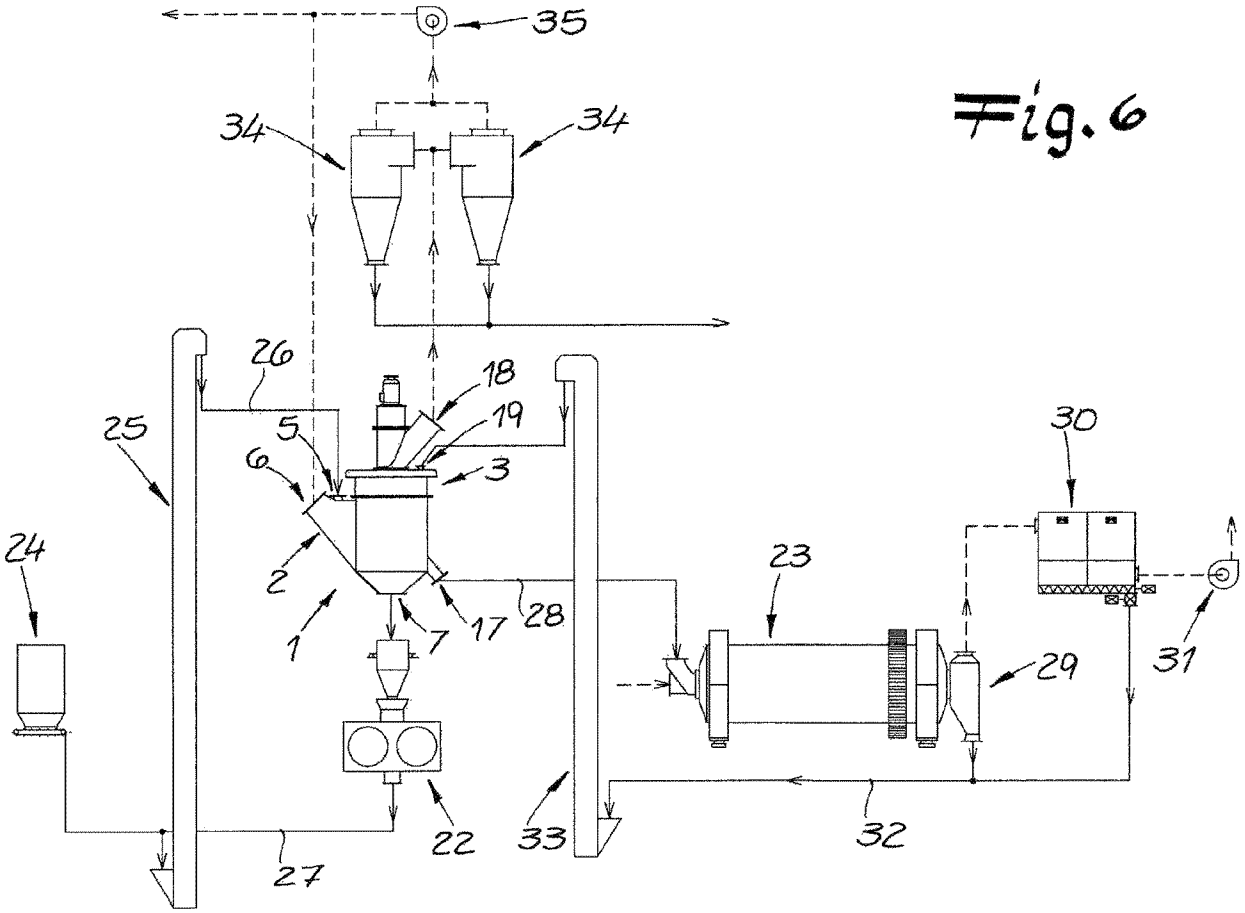
FIG. 6 is a schematic view of a dual-stage grinding mill with an air classifier according to the invention.

The multistage sifter 1 according to the invention can be integrated in a single-stage or multistage grinding mill, as shown by way of example in FIG. 6, a modality that is particularly preferred. An exemplary cement grinding mill is shown there. In the center of the figure, the multistage sifter 1 is visible; it is composed of a static sifter 2 and dynamic sifter 3. Shown below the sifter 1 is a first comminuter 22 that is a roll crusher, representing a material bed roll mill 22. Furthermore, also visible is a comminuter 23 that is a ball mill 23.

The shown two-stage grinding mill operates as follows:

The starting material that is to be comminuted is supplied from one or several bunkers 24 such as; for example, via the conveyors 25 and 26, which end in the air classifier 1 at the material inlet 5. The material is here sifted into three fractions as described above. The coarse material that is sifted and discharged via the coarse-particle outlet 7 is returned to the roll crusher 22. From there, the conveyors 27, 25, and 26 transport it to the air classifier 1 once more. The material that is sifted and discharged in the second sifting stage, meaning the middle fraction, is then fed to the ball mill 23 via the conveyors 28.

The grinding mill thus has the roll crusher 22 for pre-grinding the material and the ball mill 23 for postgrinding the material. The ball mill 23 is provided, for example, with a material exhaust 29, a dust removal filter 30 and a mill fan 31. The material discharged from the ball mill 23 is therefore fed via the conveyors 29, 32, 33 to the dynamic sifter 3. It there undergoes the second sifter stage once more via the material inlets 19.

The finest fraction is drawn off from the air classifier, specifically the dynamic sifter 3 together with the gases through the fine gas outlet 18 and into the separating cyclones 34 that are downstream. The finished product is separated here from the gases that were drawn off by the fan 35 and in part recirculated into the air classifier 1 and in part or completely to a dust removal modality.

The shown two-stage grinding mill can be modified by an alternate design. Thus, it is possible to place for example the roll crusher 22 above the air classifier 1, unlike in the illustrated design. In this case, the fresh material that is to be ground is first fed to the roll crusher, and from there the preground material is fed into the air classifier according to the invention. Here, the material is separated once more into three fractions in the manner as described above. This embodiment is not shown.

Alternately, it is possible to integrate a second, separate air classifier in the dual-stage grinding mill, so that the discharged material from the ball mill is not fed to the first air classifier as shown in the figures but instead to a separate second air classifier, not shown here. As an alternate option, it is also possible to operate only with a single comminuter such as, for example, the shown roll crusher, which is why the additional ball mill can be omitted. Finally, the finishing milling step occurs in the roll crusher, and the air classifier according to the invention and the roll crusher constitute a "simple," "single-stage" recirculating grinding mill. This aspect is not shown in the drawing. Nevertheless, the multistage sifter according to the invention can be used with equal effectiveness in different types of grinding mills.

The invention claimed is:

1. An apparatus for separating granular material into at least three fractions and comprising:

at least one static cross-flow sifter having several impact and flow-conducting elements stepped one below the other in a housing having a first material inlet, at least one sifting-gas inlet and at least one coarse-particle outlet, and a dynamic sifter having a rotary rod basket and a housing containing the basket and having at iz least one medium-particle outlet and one fine-particle outlet, the housing of the static sifter merging directly horizontally and laterally into the housing of the dynamic sifter, the rod basket of the dynamic sifter being rotatable about a vertical axis.

2. The apparatus according to claim 1, wherein the housing of the static sifter merges with a tangential, spiral, or radial orientation, or an orientation between a radial or tangential orientation into the housing of the dynamic sifter.

3. The apparatus according to claim 1, wherein the housing of the dynamic sifter has an upper housing section holding the rotary rod basket and a lower housing section into which merges the housing of the static sifter.

4. The apparatus according to claim 1, wherein the impact or flow-conducting elements that are angled relative to each other.

5. The apparatus according to claim 4, wherein the angle of impact or flow-conducting elements is adjustable.

6. The apparatus according to claim 1, wherein the impact or flow-conducting elements are formed by roof-shaped structures.

7. The apparatus according to claim 6, wherein the roof-shaped structures can be displaced horizontally.

8. The apparatus according to claim 1, wherein at least one chute wall of the housing of the static sifter is oriented at an acute angle between 10° and 70° relative to the vertical.

9. The apparatus according to claim 1, wherein a sifting zone of the static sifter formed between the impact or flow-conducting elements stepped one above the other is oriented at a preset angle of 10° to 70° relative to the vertical.

10. The apparatus according to claim 1, wherein the sifting-gas inlet is formed by at least one inlet opening that extends at an angle above the elements.

11. The apparatus according to claim 1, wherein the sifting-gas inlet is formed alternately or additionally by a plurality of openings formed in a chute wall of the housing of the static sifter.

12. The apparatus according to claim 1, further comprising:

air distributors upstream in the direction of flow of the impact or flow-conducting elements inside the housing of the static sifter.

13. The apparatus according to claim 1, wherein the housing of the dynamic sifter has at least one second material inlet.

14. The apparatus according to claim 1, wherein the housing of the dynamic sifter is cylindrical at least in sections.

15. The apparatus according to claim 1, wherein two or more of the static sifters are laterally connected to the dynamic sifter by one housing.

16. The apparatus according to claim 15, wherein the static sifters are angularly equispaced at 360°/n, where n is the number of the static sifters.

17. A grinding mill for the comminution of granular material having at least one first comminuter and the apparatus according to claim 1, wherein material discharged from the first comminuter enters the static sifter through the first material inlet, coarse material discharged via the coarse-particle outlet of the static sifter is fed to the first comminuter, and medium material discharged from the dynamic sifter is fed to the first comminuter or an additional second comminuter.

18. The mill according to claim 17 having a second comminuter, wherein medium material discharged from the dynamic sifter is fed at least partially to the second comminuter, and material discharged from the second comminuter is fed via the second material inlet to the dynamic sifter or to a separate, second air classifier.

19. The mill according to claim 18, wherein the first comminuter is a roll crusher or the second comminuter is a ball mill.

20. An apparatus for separating granular material into at least three fractions and comprising:

at least one static cross-flow sifter having a housing having a first material inlet and a sifting-gas inlet, several impact and flow-conducting elements stepped one below the other in the housing below the inlets, and a downwardly opening coarse-particle outlet below the elements; and a dynamic sifter having an upper housing part having a fine-particle outlet, a rotary rod basket rotatable about a vertical axis and contained in the upper housing part, and a lower housing part underneath the upper housing part and having a downwardly opening medium-particle outlet, the housing of the static sifter being level with and merging in a spiral or tangential manner and directly laterally into the lower housing part.

21. The apparatus according to claim 20, wherein the housing of the dynamic sifter is provided with one or several additional air supplies in the upper housing part thereof.

22. The apparatus defined in claim 20, wherein the fine-particle outlet opens upwardly out of the upper housing part flow through the apparatus is from the inlets down through the static filter where coarse particles are separated and fed out through the coarse-particle outlet and medium and fine particles are fed up to the upper housing part whence fine particles are separated and fed upward out of the fine-particle outlet and medium particles are fed downward through the lower housing part to the medium-particle outlet.

* * * * *